US008556569B2

(12) United States Patent
Molitor et al.

(10) Patent No.: US 8,556,569 B2
(45) Date of Patent: Oct. 15, 2013

(54) METHOD FOR OPERATING STEAM TURBINE WITH TRANSIENT ELEVATED BACK PRESSURE

(75) Inventors: Michael J. Molitor, Guilderland, NY (US); William G. Gorman, Malta, NY (US)

(73) Assignee: General Electric Company, Schenectady, NY (US)

( * ) Notice: Subject to any disclaimer, the term of this patent is extended or adjusted under 35 U.S.C. 154(b) by 892 days.

(21) Appl. No.: 12/649,800

(22) Filed: Dec. 30, 2009

(65) Prior Publication Data

US 2011/0158786 A1 Jun. 30, 2011

(51) Int. Cl.
*F01D 19/00* (2006.01)
*F01D 21/14* (2006.01)

(52) U.S. Cl.
USPC ..... 415/1; 415/17; 415/26; 415/118

(58) Field of Classification Search
USPC ..... 415/1, 17, 26, 27, 28, 29, 47, 118
See application file for complete search history.

(56) References Cited

U.S. PATENT DOCUMENTS

| | | | | |
|---|---|---|---|---|
| 4,004,424 | A | 1/1977 | Maddagiri | |
| 4,005,581 | A * | 2/1977 | Aanstad | 60/660 |
| 6,606,366 | B2 * | 8/2003 | Koiwai et al. | 376/210 |
| 6,865,935 | B2 * | 3/2005 | Vandervort | 73/168 |
| 7,117,662 | B2 * | 10/2006 | Hirayama et al. | 60/39.27 |
| 7,343,744 | B2 | 3/2008 | Abelson et al. | |
| 2011/0158786 | A1 * | 6/2011 | Molitor et al. | 415/1 |

* cited by examiner

*Primary Examiner* — Edward Look
*Assistant Examiner* — Christopher R Legendre
(74) *Attorney, Agent, or Firm* — Ernest G. Cusick; Frank A. Landgraff

(57) ABSTRACT

A method and control system can implement a transient exhaust pressure protection logic to avoid a turbine exhaust vacuum trip due to a short duration turbine exhaust pressure transient that may be caused by a large reduction in turbine flow coupled with a transient increase in exhaust pressure, which specifically occurs during full load rejections. When full load rejection conditions are sensed by power load unbalance and confirmed by secondary indications, normal alarm settings and trip settings for turbine exhaust pressure are blocked for a delay period while transient operating limits are in place.

11 Claims, 5 Drawing Sheets

METHOD FOR OPERATING STEAM TURBINE WITH TRANSIENT ELEVATED BACK PRESSURE

BACKGROUND OF THE INVENTION

The invention relates generally to steam turbines and more specifically to a method for operating steam turbines with transient elevated back pressure.

Condensing steam turbines are provided with allowable exhaust pressure operation guidelines which are intended to protect the steam turbine from potential damage that could occur with excessively high exhaust (condenser) pressure. The guidelines include exhaust pressure alarm and trip limits that are usually presented as a function of the last stage bucket's (LSB) annulus velocity (VAN). Annulus velocity is the steam velocity measured at the exit of the bucket and is a direct function of the flow through the last stage, its area, and the inverse of condenser pressure.

Turbine stage pressure varies approximately linearly with flow. For representation of steam velocity (flow), stage pressure may be monitored at various points for use by the turbine control system as an indication of the last stage bucket flow. Typically, reheat or intermediate pressure (IP) turbine exhaust or low-pressure (LP) turbine inlet pressure is used to determine flow in the LP turbine. Steam turbines with low-pressure extractions may use the LP extraction pressure as the indicator of last stage flow. If the actual turbine exhaust pressure exceeds the alarm setting for a given calculated annulus velocity, a turbine control system may provide the operator a warning that the actual exhaust pressure exceeds the limit so that the operator can take alternative action if possible. The turbine control system may permit continuous operation of the unit in the alarm region of allowable exhaust pressure operation curve without tripping the unit. However if the measured exhaust pressure, exceeds the trip setting for a given calculated annulus velocity, the turbine control system will immediately trip the unit by closing the steam control valves. These valves providing quick closing type operation may be called various names, such as admission valves, cut-out valves, control valves, trip valves, turbine trip and control valves, etc.

In establishing allowable exhaust pressure operating guidelines, it has been recognized that the potential of last stage bucket damage increases at lower annulus velocities and is highest at combinations of low flow and higher exhaust pressure. Consequently variable operational limits apply with lower allowable pressures at very low VAN, and higher allowable exhaust pressures at higher VAN with a varying pressure in between. Existing alarm and trip curves for steam turbine operation for exhaust pressure limits versus VAN incorporate the more restrictive exhaust pressure requirements at lower values of VAN.

During a load rejection, steam turbine flow is rapidly reduced by the main steam turbine control valves and control valves for reheat and LP admission (if applicable) to prevent turbine overspeed. The turbine load is reduced to no load or house load and because these loads are very small, the VAN is almost zero due to the very low flow.

For units with water-cooled condenser, and units without turbine bypass systems, the exhaust pressure transients associated with load rejections has generally not been an issue, because exhaust pressure transients have remained within the allowed exhaust pressure limits. However, for units with air cooled condensers and/or bypass systems the resulting pressure transient is more problematic and the potential for a trip during the load rejection due to high exhaust pressure is increased. For units with variable exhaust pressure operation limits this has been a larger issue due to lower allowed exhaust pressures at low VAN compared to the allowed exhaust allowed at full load.

Even though turbine steam flow is reduced, bypass systems divert boiler steam to the condenser increasing condenser pressures. This diverted flow results in increased heat rejection to the condenser and higher exhaust pressures. Runback of the heat source (e.g. supplemental firing or gas turbine runback for combined cycle units, or firing for fossil units) may result in an exhaust pressure spike. FIG. 1 illustrates a simulation exhaust pressure and VAN following a load rejection. At t=0, VAN 10 drops close to 0 and exhaust pressure spikes 20. Over several minutes the exhaust pressure transient decays 30. If the pressure exceeds a limit (not shown), the current steam turbine control system logic will trip the unit even though this spike may be of short duration.

One required element for control of steam turbines is to avoid an overspeed trip under the condition of a full load rejection. This requirement is prescribed in IEEE-122, "IEEE Recommended Practice for Functional Performance characteristics of Control Systems for Steam Turbine Generators", or similar regulatory documents. Contractually, this requirement is often expanded to specify that the steam turbine be capable of a full load rejection without initiating a turbine trip.

Accordingly, it would be desirable to maintain the steam turbine in a safe condition and at the same time avoid a turbine exhaust vacuum trip due to a short duration condenser pressure transient caused by a large reduction in turbine flow coupled with a transient increase in exhaust pressure, which specifically occurs during full load rejections.

BRIEF DESCRIPTION OF THE INVENTION

Briefly in accordance with one aspect of the present invention, a control system is provided for avoiding transient turbine exhaust trips for a steam turbine under load rejection conditions. The steam turbine control system is adapted for operation with a transient elevated exhaust backpressure. The steam turbine control system includes a trip function adapted for activating a trip device for closure of main steam closure valves (MSCV) according to a normal operational limit on turbine exhaust pressure. A power load unbalance (PLU) function is provided for determining a load rejection. Transient protection logic is provided for blocking activation for a delay period of the trip function for the MSCV in a transient pressure operation band under defined load rejection conditions.

In accordance with another aspect of the present invention, a method is provided for operating a steam turbine with transient elevated exhaust pressure. The method includes operating a steam turbine according to normal alarm settings and normal trip settings for turbine exhaust pressure as a function of last stage bucket annulus velocity (VAN). The method monitors for designated load loss conditions. Under the designated load loss conditions, a transient exhaust pressure alarm and trip operating region is implemented. Operation may continue according to the transient exhaust pressure operating region for a predetermined time period, before normal alarm settings and trip settings are restored.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including allowing turbine operation to continue safely under elevated transient exhaust pressure conditions that heretofore would require shutdown of the turbine. The method and system avoid a turbine exhaust vacuum trip due to a short duration condenser pressure transient caused by a large reduction in turbine flow coupled with a transient increase in exhaust pressure, which specifically occurs during full load rejections. Continued operation during such transient exhaust pressure conditions avoids extended downtime for recovery from the turbine shutdown and consequent economic losses to the plant operator.

In order to accommodate this expanded requirement with respect to steam turbine exhaust vacuum trip, transient exhaust pressure protection logic is added to the steam turbine control system. The new protection logic recognizes that last stage bucket operation at higher exhaust pressure is acceptable for a limited time.

The intent of including transient exhaust pressure protection logic in the control system is to avoid a turbine exhaust vacuum trip due to a short duration condenser pressure transient caused by a large reduction in turbine flow coupled with a transient increase in exhaust pressure, which specifically occurs during full load rejections. The logic is not intended to accommodate transients caused by "normally expected" events such as condenser cleaning, condensate pump switching, runbacks and setbacks that should be accommodated in the plant design or its operation. Such events may be accommodated within the normal alarm and trip limits.

The transient exhaust pressure protection logic will supplement the traditional absolute pressure level alarm and tripping functions currently being provided.

Figure 1:
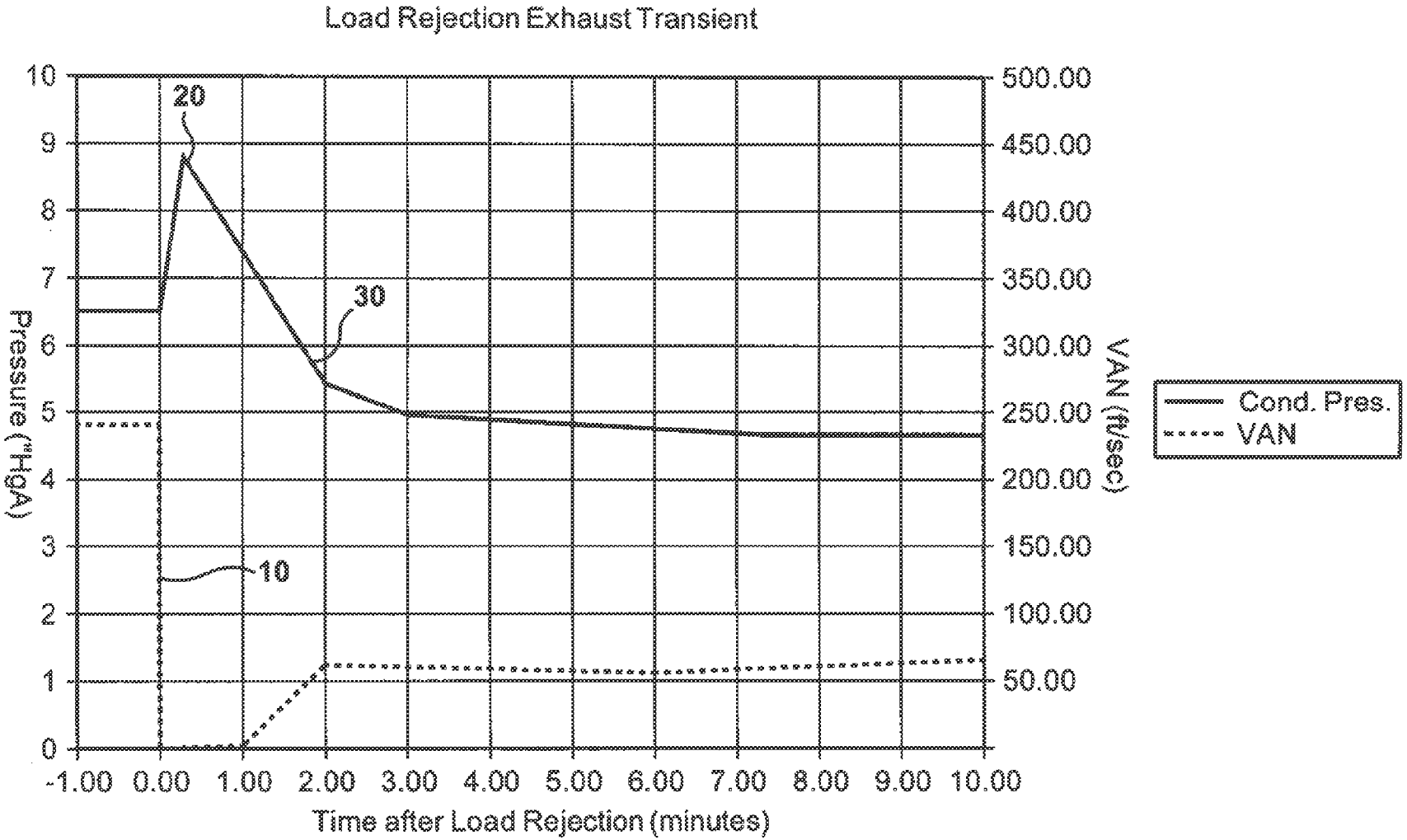
FIG. 1 illustrates a simulation for exhaust pressure and VAN following a load rejection.
Figure 2:
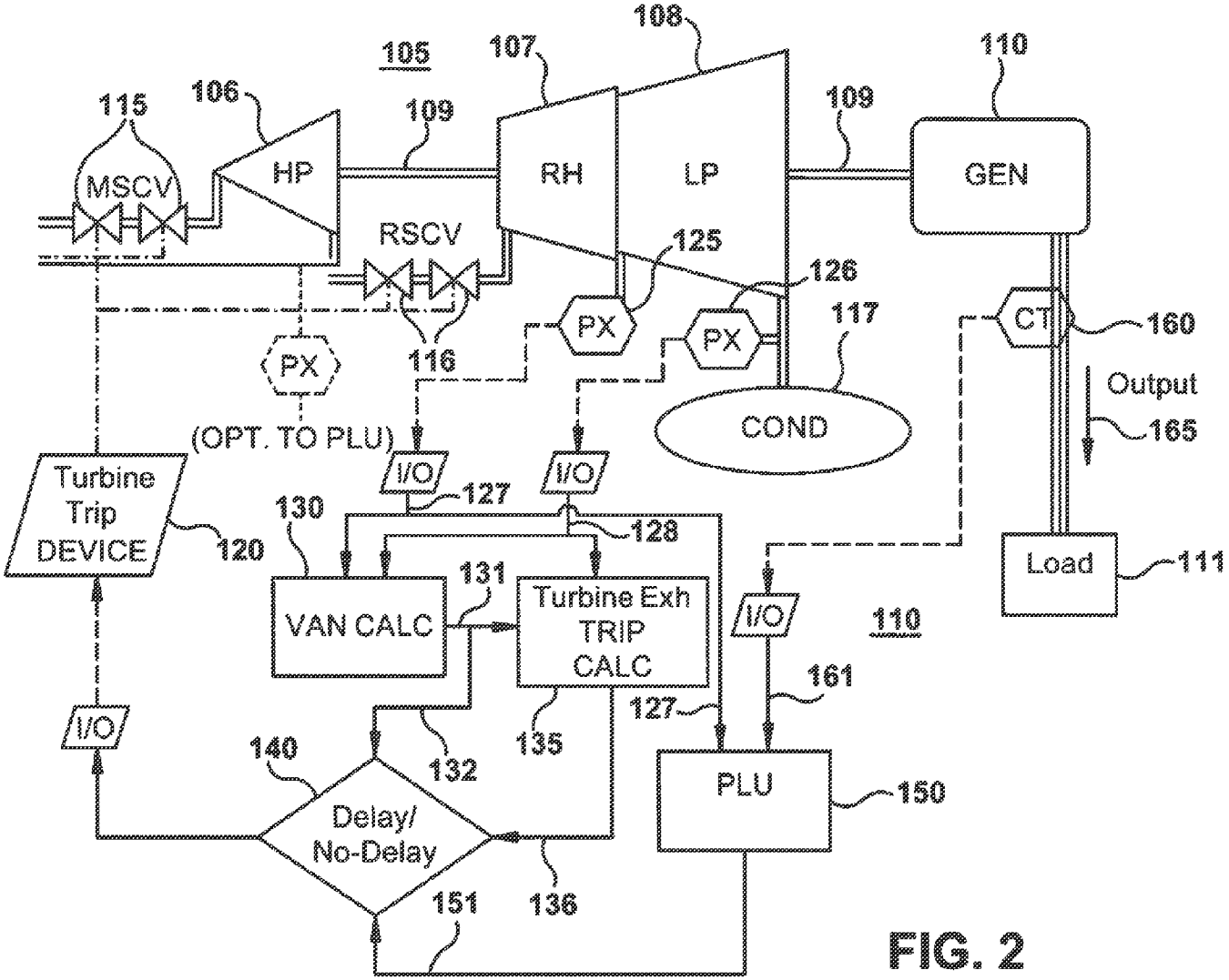
FIG. 2 illustrates operational and trip limits for exhaust pressure versus last stage bucket annulus velocity, which incorporate transient exhaust pressure operation.

FIG. 2 illustrates an exemplary steam turbine 105 and steam turbine control system 110 providing expanded turbine exhaust pressure limits during load loss conditions. It should be understood that the applicability of the present control scheme is not limited by the exemplary turbine configuration including units with and without reheat. In other turbine arrangements, pressure monitoring may be performed at other locations and other measurements and representations of steam flow and steam velocity at the last buckets may be provided.

The steam turbine 105 includes a high-pressure steam turbine 106, a reheat steam turbine 107 crossing-over to a low-pressure steam turbine 108. The steam turbines may be coupled on a common shaft 109 to an electrical generator 110 and may also be coupled to a gas turbine (not shown). The electrical generator 110 outputs to a load 111, which may be local or a transmission system. Main steam control valves (MSCV) 115 provide for rapid isolation of the steam input to the high-pressure turbine 106. Reheat steam control valves (RSCV) 116 provide rapid isolation for steam to the reheat steam turbine. The low pressure turbine 108 exhausts to steam condenser 117. A turbine trip device 120 is provided to quickly close the steam supply to the high-pressure turbine 106 and reheat turbine 107. The turbine trip device 120 may receive trip signals from various other functions of the turbine control system (not shown) for the protection of the turbine systems.

Instruments within the turbine system provide known inputs to the turbine control system for monitoring and protection of the turbines and other components. In particular, a pressure transmitter 125 for the turbine stage pressure between the RH turbine 107 and the LP steam turbine 108 and a pressure transmitter 126 for turbine exhaust pressure provide input to the turbine control system 110. LP inlet pressure (LPIP) 127 and turbine exhaust pressure 128 are provided to a calculation of VAN 130. The calculated VAN 131 and turbine exhaust pressure 128 are provided to a turbine exhaust trip calculation (also called vacuum trip) 135. Under the existing system, the turbine exhaust pressure trip is provided directly to the turbine trip device for closing the MSCVs 115/RSCVs 116. However, the closing of the MSCVs/RSCVs leads to extended and undesirable recovery time for the turbines.

According to the present invention, a time delay 140 may be provided to the exhaust pressure trips to allow continued operation under elevated transient exhaust pressure conditions that would otherwise result in exhaust pressure alarms and trips of the MSCVs/RHCVs. The time delay 140 allows transient protection logic to extend the allowable exhaust pressure during a load rejection condition. The load rejection condition may be determined by a power load unbalance (PLU) function 150. Current transformer 160 senses the electrical output from the generator 110. The PLU function 150 compares the generator electrical output 165 with the turbine load as determined by VAN 131. If an unbalance between the turbine load as determined by LPIP 127 and electrical load 161 exceeds a predetermined value, rate and duration indicating a load rejection, then a PLU signal 151 is sent to the time delay circuitry 140. If a separate VAN signal 132 confirming a low load is sent to the time delay circuitry, then a time delay is imposed on the exhaust pressure alarms and trip. Under high turbine exhaust conditions, when delay conditions are not supported, turbine exhaust trip signal passes to the turbine trip device 120 without a delay. A more detailed description of the extended transient exhaust pressure protection logic will be described relative to FIG. 4.

Figure 3:
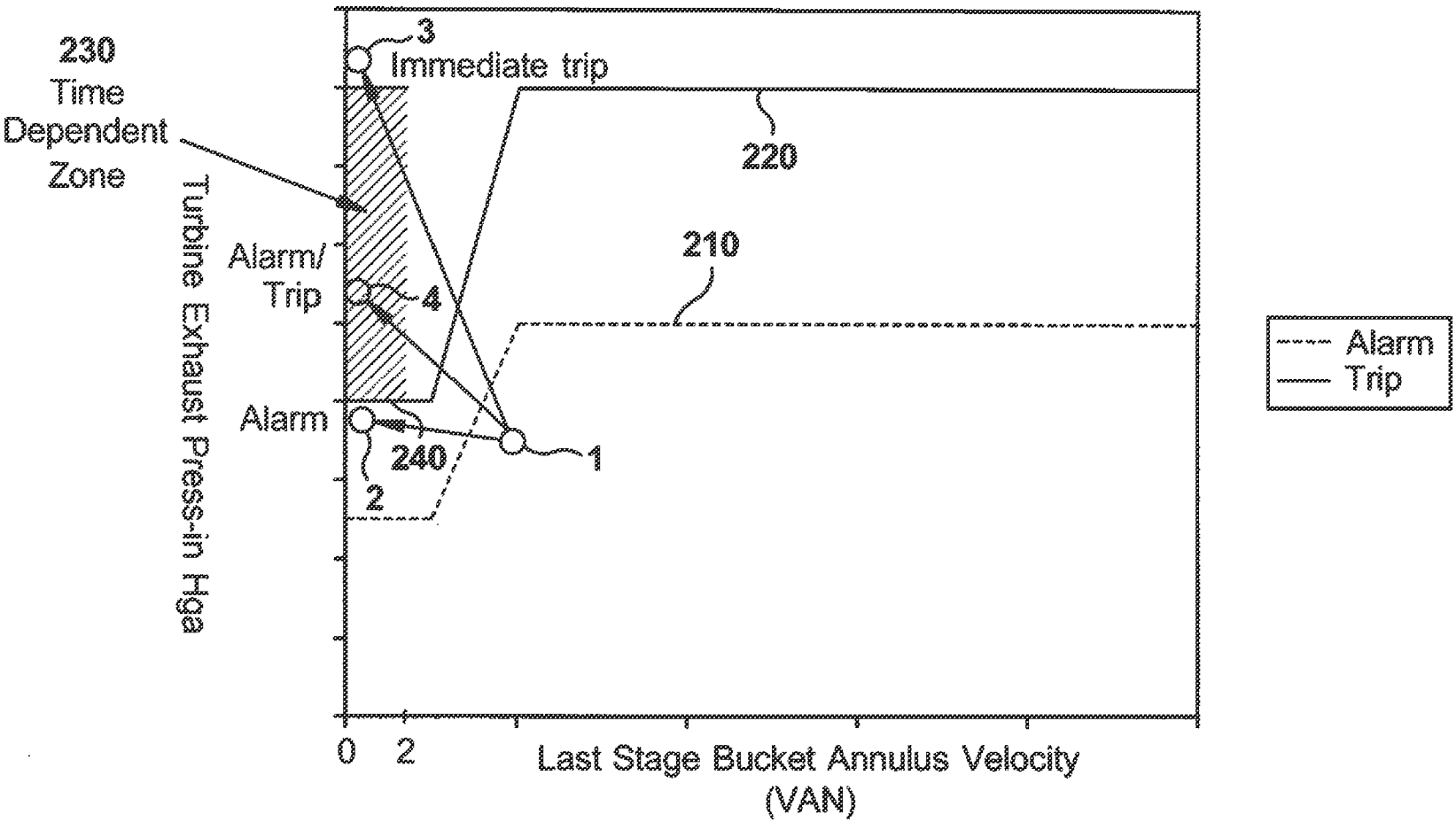
FIG. 3 illustrates an exemplary steam turbine and steam turbine control system providing expanded turbine exhaust pressure limits during load loss conditions.

FIG. 3 illustrates operational and trip limits for exhaust pressure versus last stage bucket annulus velocity, which incorporate both normal and transient exhaust pressure operation. Alarm curve 210 represents the steady state operational alarm limits for exhaust pressure as a function of VAN. Trip curve 220 represents the steady state exhaust pressure trip limits for exhaust pressure as a function of VAN. The shaded area 230 represents a time dependent, transient exhaust pressure operation region. The transient exhaust pressure operation area falls between a VAN of 0 and a VAN of Z, representing operation between full-speed no-load (FSNL) and house load, the expected operational conditions after a load rejection. Combined cycle units are expected to be at FSNL, as the gas turbine will usually be supplying plant auxiliary load. Whereas in a conventional plant, the steam turbine would be carrying the plant auxiliary load, usually 4-6% of full load. At calculated VANs greater than the Z setting, the steady state protection logic will provide alarms and or trips as required based on the actual exhaust pressure and the allowed limits. At calculated VANs less than the Z setting, the steady state protection logic should provide alarms and trips unless the transient protection logic is active. Operation according to the transient protective scheme is functional when the PLU function is activated by a load reduction greater than the PLU setting and the calculated VAN falls within the shaded region 230.

Point 1 represents a unit operating at or close to full load. If a unit is at full load as indicated by Point 1, were to undergo a load rejection then system response would depend on the plant conditions that result. At Point 1 starting point, the unit is operating normally below normal alarm setting and trip settings. At Point 2, the unit is operating above the normal alarm setting 210, below the normal trip setting 220, and outside the transient exhaust pressure operation region 230. Transient exhaust pressure transient protection logic is not required for continued operation at Point 2. At Point 3, an immediate trip is initiated as the exhaust pressure exceeds the maximum trip setting, and is even above the exhaust pressure for transient exhaust pressure operation region 230. Operation at Point 4, within the transient exhaust pressure operation region 230, immediately initiates an alarm indicating that the transient trip delay is active, allowing operation in the region without a trip for the duration of a trip delay period.

In determining the operating load VAN, the turbine control system will continue to use a turbine stage pressure as an indication of steam turbine last stage mass flow. Mass flow will be assumed to be linear with a measured pressure. The actual operating exhaust pressure may be used to determine VAN. The control system will compare the operating VAN to the specific unit's VAN based limits. The control system will monitor exhaust pressure with both the traditional steady state and transient logic active. Z feet/sec represents the VAN zone for which the transient exhaust pressure protection logic could be active.

The transient protection logic will be activated if the PLU function is activated by a load reduction greater than the PLU setting and the calculated VAN goes to a value less than a Z value. PLU provides the required load magnitude and rate change sensitivity required for determining a load rejection. As an alternative input parameter, generator load (for example generator load amperes) may be used for determining that the unit is at FSNL or house load (i.e., less than the Z-value) instead of using VAN below an actual Z-value.

If the transient exhaust pressure logic is activated, the turbine control system will provide the necessary protection according to the location on the operating map. If the resulting operating point is in the time dependent transient exhaust pressure operation region 230, the turbine control system will monitor the operation time and if that operating time exceeds a predetermined value the turbine is to be tripped.

If the exhaust pressure drops below the lower end 240 of the transient exhaust pressure operation region 230 within the allotted time period, the unit is not to be tripped and the transient protection logic is disabled to prevent drifting in and out of the time dependent zone.

When the unit is shutdown, (control valve closed, tripped, etc) the transient exhaust pressure protection is deactivated. In the exemplary embodiment, this occurs when speed decays to 75% of rated speed, and is not reactivated until the load on the unit has reached the activation load.

When the operating point enters the time dependent transient exhaust pressure operation region 230, and the transient protection logic is activated, the control system may count the excursion as an incident and monitor the time period that the unit operates in the time dependent zone. The number of incidents may be recorded and times accumulated for each event and total, and archived. The control system may provide on the operator display, the unit's allowable exhaust pressure guideline VAN curve, and the real time operating point. Alarms may be annunciated and displayed.

Figure 4:
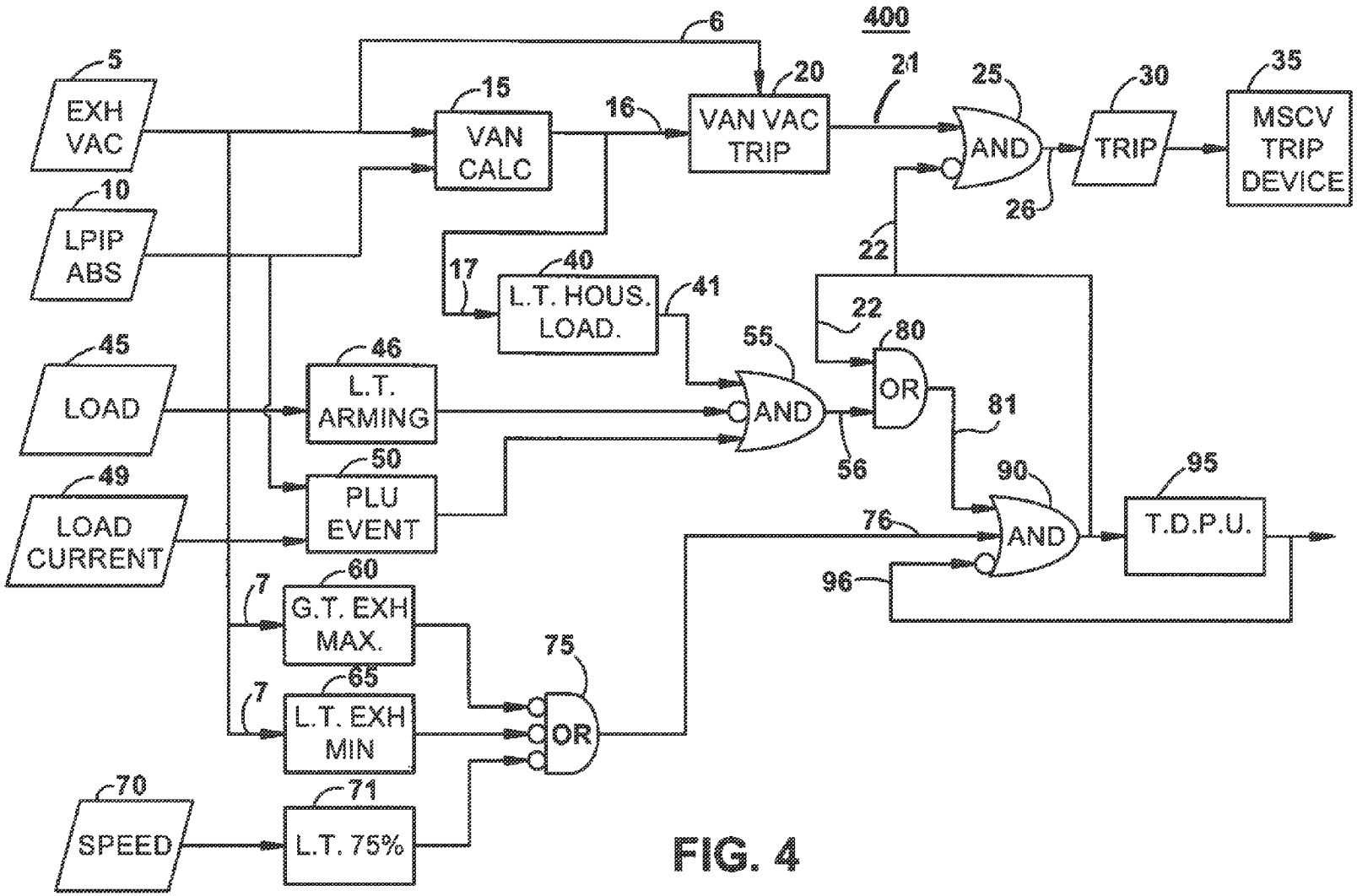
FIG. 4 illustrates an embodiment of logic for delay of the exhaust pressure trip under load rejection conditions.

FIG. 4 illustrates an embodiment of a transient protection logic 400 for delay of the exhaust pressure trip under load rejection conditions. Turbine exhaust pressure 5 and LP inlet pressure (LPIP) 10 are sensed and provided to a VAN calculation 15. The calculated VAN 16 and the turbine exhaust pressure 6 are provided to the turbine exhaust pressure trip function 20 for the normal trip range. If turbine exhaust pressure 6 is above the trip level for the calculated VAN 16, a trip condition 21 is generated. If the trip condition 21 exists and a low value for delay signal 22 is generated, AND gate 25 blocks the trip logic signal 26 from passing to trip output 30 onto MSCV trip device 35. If the trip delay signal 22 is not generated or has timed out, then the MSCV trip device may be activated.

Confirmatory logic for the trip delay signal 22 may be provided as follows. The determination of load rejection is provided at AND gate 55. VAN calculation signal 17 is provided to house load check 40 to determine if steam load has dropped to house load level that would exist after a turbine trip. House load confirmatory signal 41 is passed to AND gate 55. A load check 45 may be performed for a minimum load level to establish arming 46 of AND gate 55 for PLU event signal. The PLU 50 establishes the final input to AND gate 55. The PLU event 50 is determined by a drop of a predetermined value in electrical load output 49 relative to steam load as determined by LPIP 10. OR gate 75 may incorporate logic for boundary limits on expanded transient exhaust pressure limits. Exhaust pressure signal 7 is compared against a maximum allowable transient exhaust pressure limit 60 and a minimum allowable transient exhaust pressure limit 65. If the maximum or minimum allowable transient exhaust pressure are violated, then OR gate 75 is triggered. Likewise if turbine speed block 71 determines from turbine speed measurement 70 that the turbine speed has slowed to less than a predetermined fraction of full speed indicating that the turbine has likely tripped already, there is no need to prevent trip of the MSCV.

AND gate 90 output 22 determines if AND gate 25 delays an exhaust pressure trip signal 21. A low state on AND gate 90 will cause AND gate 22 to output a trip signal immediately in response to a trip input condition. A high state on AND gate 90 will cause AND gate 22 to delay a trip signal. For AND gate 90 to output a high state: input 81 from OR gate 75 must be low (none of the inputs 60, 65 or 71 be active), input 96 from TDPU 95 be low (time delay must not have expired) and output 56 from OR gate 75 must be high (operating in the transient pressure boundary and turbine speed above designated value). OR gate 80 outputs a low if neither AND gate 90 output 22 is low nor AND gate 55 output is low.

Figure 5:
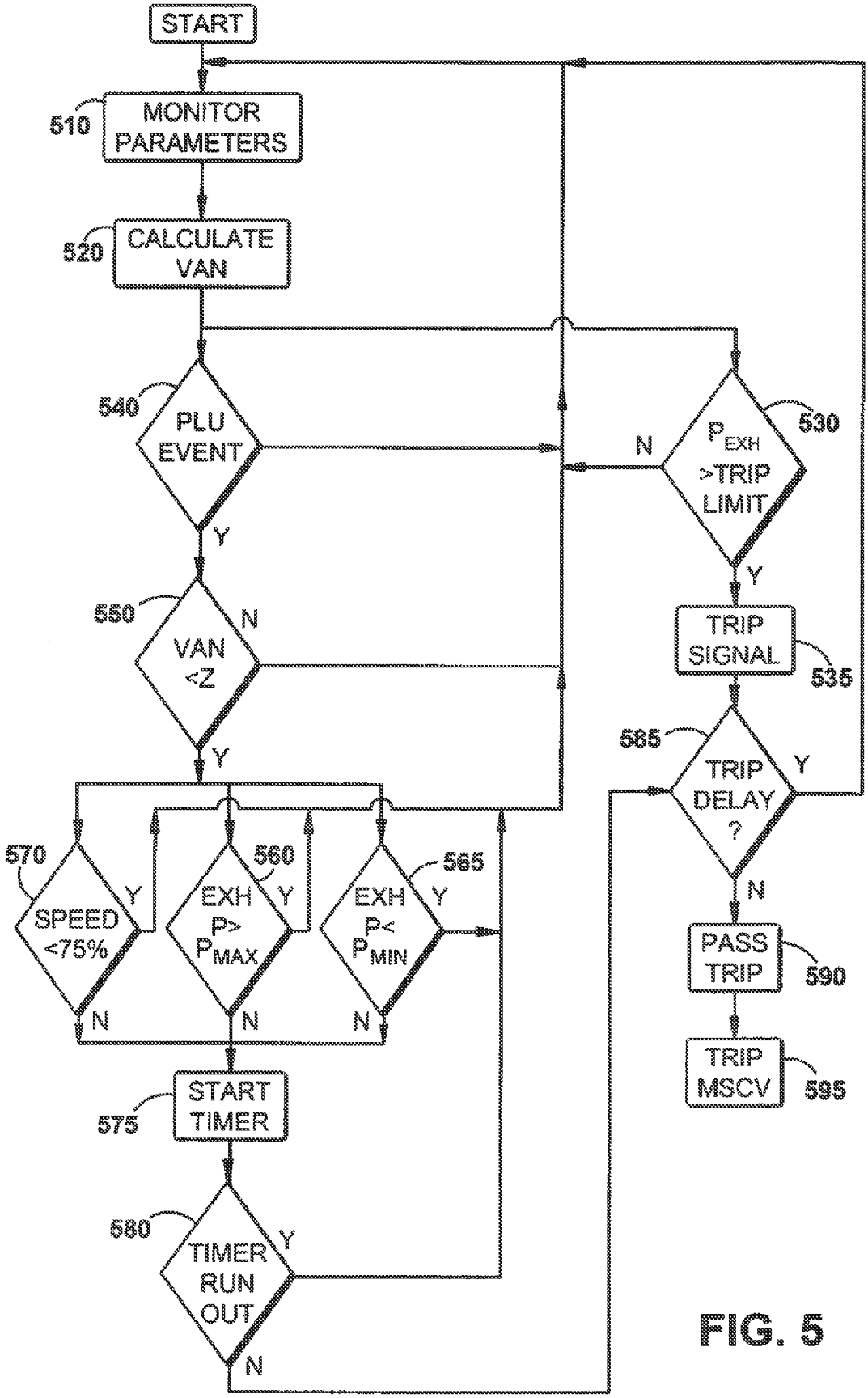
FIG. 5 illustrates a flowchart for a method of operating a steam turbine with expanded transient exhaust pressure protection limits.

FIG. 5 illustrates a flowchart for a method of operating a steam turbine with expanded transient exhaust pressure protection limits. In step 510 continuously monitor turbine operating parameters including turbine exhaust pressure, turbine vertical joint pressure, electrical load, turbine speed. In step 520 calculate VAN. In step 530 determine if turbine exhaust pressure exceeds normal state turbine exhaust pressure limits, then establish a turbine device trip signal in step 535.

Next, it is determined whether any conditions would warrant operating in the expanded transient turbine exhaust pressure operation, thus allowing blocking the trip signal from reaching the trip device for the MSCVs. In step 540, it is determined if a PLU event has occurred. Such event occurs, as previously described, when the PLU function is armed by generator load being above a predetermined level, and a drop in generator load occurs as a predetermined amount relative to turbine load, as determined by VAN. In step 550, it is determined whether the calculated VAN is below a predetermined level that confirms the turbine is at house load.

In step 560, it is determined if turbine exhaust pressure exceeds the transient operating band. In step 565, it is determined if turbine exhaust pressure is below the transient operating band. In step 570, it is determined if turbine speed is below 75% of full speed, indicating that the turbine has tripped already. If any of these exceptions occur, then operation under the transient turbine exhaust limits should not continue and any active trip signal should be passed. Otherwise for steps 560, 565 and 570 conditions suggest that the active trip signal may be delayed for a predetermined time during operation in the transient exhaust pressure operation region. A delay timer for the predetermined time delay is started in step 575. If the timer has not time timed out, then an active trip signal is not passed. If the timer has timed out in step 580, it is decided in step 585 whether the trip signal is passed. An active trip signal is passed 590 through to the turbine trip device, causing the MSCVs to shut in step 595.

While various embodiments are described herein, it will be appreciated from the specification that various combinations of elements, variations or improvements therein may be made, and are within the scope of the invention.

The invention claimed is:

1. A method for operating a steam turbine with transient elevated exhaust pressure, the method comprising:

operating a steam turbine according to normal alarm settings and normal trip settings for turbine exhaust pressure as a function of last stage bucket annulus velocity (VAN);

monitoring for designated load loss conditions;

initiating a transient exhaust pressure alarm and trip operating region under the designated load loss conditions; and operating according to a transient exhaust pressure operating region.

2. The method of claim 1, the step of monitoring for designated load loss conditions comprises:

enabling a power load unbalance (PLU) function under designated conditions;

monitoring turbine power and generator load; and determining a power load unbalance exists when a difference between steam turbine power and generator load exceeds a predetermined value, rate and duration.

3. The method of claim 1, the step of initiating an expanded transient exhaust pressure alarm and trip operating region comprises:

signalling when a power load unbalance is determined;

confirming that the turbine is at unloaded conditions;

initiating transient exhaust pressure logic alarm when operating in expanded exhaust pressure operating region;

starting a time delay on a trip activation for turbine exhaust pressure; and initiating transient exhaust pressure trip limits.

4. The method of claim 3, the step of confirming that the turbine is at unloaded conditions comprises:

determining that VAN is below a predetermined value.

5. The method of claim 3, the step of confirming that the turbine is at unloaded conditions comprises:

determining that generator load current is less than a predetermined value.

6. The method of claim 1, the step of operating according to the transient exhaust pressure operating region comprising:

displaying on an operator's display the transient exhaust pressure trip limits.

7. The method of claim 1, the step of operating according to the transient exhaust pressure operating region further comprising:

activating normal alarm settings and trip settings for turbine exhaust pressure when an operating time in the transient exhaust pressure operating region exceeds a predetermined time limit.

8. The method of claim 1 the step of operating according to the transient exhaust pressure operating region further comprising:

operating according to normal alarm settings and trip settings for turbine exhaust pressure when operating conditions fall outside the transient exhaust pressure operating region.

9. The method of claim 1, the step of operating according to the transient exhaust pressure operating region further comprising:

disabling the transient exhaust pressure operating limits if exhaust pressure falls below a lower level of the transient exhaust pressure operating region.

10. The method of claim 1, the step of operating according to the transient exhaust pressure operating region further comprising:

a time duration for operation with transient exhaust pressure operating limits.

11. The method of claim 1, the step of operating according to the transient exhaust pressure operating region further comprising:

activating normal alarm settings and trip settings for turbine exhaust pressure if speed of the turbine drops to a designated fraction of rated speed.

* * * * *